United States Patent [19]

Fiala

[11] Patent Number: 5,000,676

[45] Date of Patent: Mar. 19, 1991

[54] METHOD AND APPARATUS FOR INCREASING THE TEMPERATURE OF CATALYSTS

[76] Inventor: Werner Fiala, Staudgasse 88, A-1180 Vienna, Austria

[21] Appl. No.: 355,891

[22] Filed: May 23, 1989

Related U.S. Application Data

[63] Continuation of Ser. No. 86,048, Jul. 20, 1987, abandoned.

[30] Foreign Application Priority Data

Nov. 21, 1985 [AT] Austria ..... 3403/85

[51] Int. Cl.[5] ..... F23D 14/18

[52] U.S. Cl. ..... 431/7; 431/255; 431/256; 431/328; 431/354; 126/92 AC

[58] Field of Search ..... 431/354, 7, 170, 255, 431/256, 328; 126/92 AC, 92 C

[56] References Cited

U.S. PATENT DOCUMENTS

| | | | |
|---|---|---|---|
| 2,552,845 | 5/1951 | Crosby | 431/328 |
| 3,380,810 | 4/1968 | Hamblin | 431/328 X |
| 3,681,002 | 8/1972 | Kweller et al. | 431/328 X |
| 4,189,294 | 2/1980 | Rice et al. | 431/7 |
| 4,502,465 | 3/1985 | Yoshinaga et al. | 431/328 X |

FOREIGN PATENT DOCUMENTS

| | | |
|---|---|---|
| 57-204712 | 12/1982 | Japan . |
| 57-207704 | 12/1982 | Japan . |

*Primary Examiner*—Carl D. Price

*Attorney, Agent, or Firm*—Hoffmann & Baron

[57] ABSTRACT

Process for heating a catalyst used for the catalytic high-temperature oxidation of a mixture of a combustible gas and air or oxygen which is introduced in the cold state. The mixture is ignited on the input side at a point which is so close to the catalyst that the mixture is burning when it reaches the surface of the catalyst.

9 Claims, 2 Drawing Sheets

METHOD AND APPARATUS FOR INCREASING THE TEMPERATURE OF CATALYSTS

CROSS REFERENCES TO RELATED APPLICATIONS

This is a continuation of co-pending application Ser. No. 086,048, filed on July 20, 1987, now abandoned.

The invention relates to a process for heating a catalyst used for the catalytic high temperature oxidation of a mixture of combustible gas and air oxygen which is introduced in the cold state, whereby the heating occurs at that side of the catalyst which is fed with the mixture.

BACKGROUND OF THE INVENTION

The reaction partners of the total oxidation, that is, fuel and oxygen, the latter may be air, if need'be, are introduced into such catalysts either separately or already as a fuel-air-mixture or fuel-oxygen-mixture in the following called "fuel-mixture" for short. For example, in customary embodiments of catalytic furnaces which are operated with propane gas the fuel is introduced through the one side of a plate shaped gas permeable catalyst by means of a distribution plate and the air or oxygen required for oxidation is received from the ambient air of the opposite disposed side of the plate shaped catalyst. In contrast thereto, in known embodiments of catalytic curlers and lighters fuel is mixed with air and the fuel-mixture is introduced into the catalyst.

In most cases the total oxidation within the catalyst occurs with the use of most fuels only after the catalyst has a certain minimum temperature the so-called "ignition temperature" which is mostly larger than the ambient temperature. Therefore, in order to initiate the total oxidation within such catalysts it is required to bring at least parts of the same to the same ignition temperature. The oxidation process can then transgress to adjacent areas by emission from these in view of the heat development which is generated simultaneously with the partial oxidation and can be finally manifested in the total catalyst.

For example, in heating devices which use catalysts the fuel gas or the fuel gas-mixture is ignited by means of an igniting flame at the surface of the element being open towards the environment; the flame generated after the ignition subsequently heats the catalyst on the surface side exposed to the environment, so that the oxidation process can diffuse toward the inside of the catalyst starting from the surface being heated by the flame.

It is common for most of the processes for increasing the temperature of catalysts in that only small parts of the catalyst are heated by ignition systems which have a low thermic capacity and that these heated parts of the catalyst are positioned at that side opposite at which the fuel or the fuel mixture flows into the catalyst. The catalyst is positioned between the fuel supply means and the igniting device, or, expressed in other words, the fuel supply means and the igniting device are positioned on opposite sides of the element which is used for the flameless oxidation. In view of this arrangement the still cold inactive catalyst must be filled with fuel or fuel-mixture at least to the igniting system before the oxidation reaction can be actuated by increasing the temperature at the outer edge of the element. Furthermore, in view of this arrangement, the flameless oxidation diffuses from the heated location into the direction which is opposite to the throughflow direction of the fuel or the fuel mixture.

The problem indicated heretofore is naturally not present if the catalyst merely has the task to completely oxidize noncumbustible residue gases from a combustion process without using a catalyst, be it in a gas heating system (JP-A-57-207704) or in an internal combustion engine. Here, the exhaust gas itself brings the catalyst to the required temperature and actuates the reaction on the catalyst.

A device is already known from (JP.-A-57-204712) which operates in accordance with the aforementioned process, wherein the catalyst is not heated by the mixture itself and wherein the heating progresses in the direction of the gas flow. However, this is obtained by a local heating of the catalyst by means of an incandescence spiral which is pushed against the catalyst only during the igniting process and by displacing the feeding tube for the mixture during the igniting process.

SUMMARY OF THE INVENTION

The invention permits a substantial simplification of the process known from JP-A-57-204712 as well as for the device required to perform the process. This is obtained in that the combustible mixture is ignited by the catalyst without any contact with the same at such a small distance from the same that it reaches the surface of the element in a flaming condition.

Above all, it seems to appear to be paradoxical to select a gas for the catalytic combustion which would be combustible without contact with the catalyst. However, there are a number of applications wherein a flameless combustion offers advantages, be it to prevent the generation of fires in heating devices, be it that the extinguishing of the flame by wind should be prevented in cigaret lighters.

The decisive advantage of the process in accordance with the invention resides in that thereby a short time substantially higher capacity can be fed to the catalyst, as will be released by the combustion of the mixture in the stationary condition. This process permits that practically the total amount of gas being present between the ignition location and the catalyst combusts like an explosion and thereby reaches a rapid increase in temperature. Thereby, the catalytic combustion is initiated within a time period in which the carry off of the fed heat into the inside of the catalyst is to be considered insignificant.

In one form of devices for performing the process the mixture is directly diverted to the catalyst by means of a Venturi tube in a common manner. The ignition now does not occur after the local heating of the catalyst, but already in the area of the Venturi tube. Thereby, a flame is at first formed which is immediately torn off at a high flow speed and drifts toward the catalyst. During a lower flow speed the flame at first remains standing, whereby it appears to start from that area of the wall of the Venturi tube at which the flow speed and the igniting speed are uniformly large. Apparently, because the combustion within the catalyst is thermodynamically preferred, the flame disappears also in the case when the combustion process in the catalyst is completely developed and the igniting flame becomes superfluous anyway. This immediate or gradual disappearing of the igniting flame is advantageous not so much for safety reasons (the flame will not get to the outside, since it is disposed in front of the catalyst), but because local overheating of the catalyst and the adjacent parts are prevented, on the one hand, and the heat yield in the catalyst itself is increased, on the other hand.

In some devices for performing the process the origin of the igniting flame is removed so far from the device that the igniting flame would not extinguish in the stationary condition without any special measures. In such cases it is recommended to provide the catalyst itself with a flow resistance or the housing which encompasses the catalyst, whereby the resistance is not disadvantageous in the stationary condition, on the one hand, but is so high that a repulsion is generated during the explosion like igniting process which blows out the igniting flame, on the other hand. Details of the process and of two devices for performing the same will be described in the following in conjunction with the drawing.

BRIEF DESCRIPTION OF THE DRAWING

FIG. 1 illustrates in a schematic manner the essential components of a catalytic igniter for tobacco products, whereby the process in accordance with the invention is applied.

DESCRIPTION OF THE PREFERRED EMBODIMENT

Figure 1:
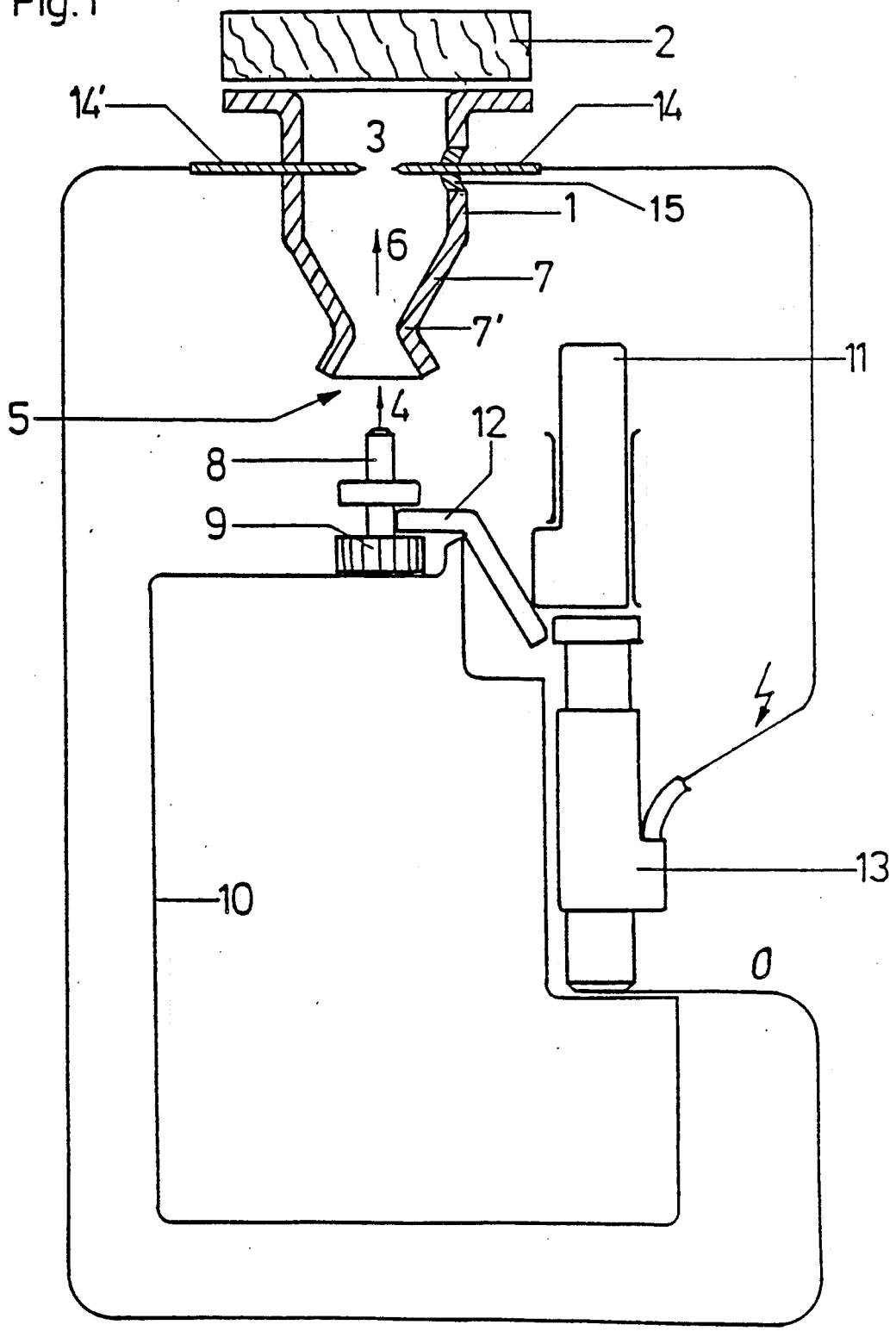
FIG. 1 and FIG. 2 each illustrate in a schematic sectional view the relevant parts of devices for the catalytic combustion and the igniting devices thereof in conjunction with the invention.

Tube 1 represents the end piece of a Venturi tube 7; the Venturi tube is provided with the reduction 7'. A high speed jet 8 is mounted in the axis of the Venturi tube which in a known manner is connected through the control valve 9 with supply tank 10. A high voltage discharge spark is used for igniting the fuel mixture 6 on igniting location 3 being positioned between electrodes 14 and 14' as soon as a high voltage of about 10 kV is generated between the electrodes 14 and 14' by actuating the piezo-striking mechanism 13. The catalytic igniter is actuated by the user by pushing down slide 11. By the downward movement of slide 11 at first the valve with the high speed jet 8 is opened through toggle lever 12, whereby fuel 4 flows with a high speed into the reduction 7' of the Venturi tube and admixes therein with air 5 to a fuel mixture 6. By a further downward movement of slide 11 the piezo-striking mechanism 13 is subsequently actuated, whereby an ignition spark is generated between the electrodes 14 and 14' which ignites the fuel-mixture 6. The flame which is generated by the ignition finally heats the catalyst 2 at that side at which the fuel mixture is fed.

It is customary to use the fuel butane or iso-butane for igniters of tobacco products; therefore some characteristics for illustrating the process or the device will be given. On the basis of the heating value of butane one calculates that at an atmospheric pressure the combustion of 8.5 $mm^3$ gas like butane the heat of 1J will be released. For this combustion the 31.1 times amount of air is required; in order to obtain a heat capacity of 1 W=1J/s,273 $mm^3$ butane-air-mixture must be oxidized per second. If, for example, such a mixture is fed through a tube with a circular shaped cross section to a catalyst and if the desired heat capacity from the catalytic oxidation is provided by P Watt, the flow speed is $V=\pi(.273P)/r^2$ cm/s. Accordingly, at a heat capacity of P=50 Watt the flow speeds are 439 cm/s or 17.4 cm/s in a Venturi tube with a circular radius $r_{min}=0.1$ cm on the reduction 7' and a circular radius of $r_{max}=0.5$ cm on the connecting location to the catalyst. Opposite to these speeds is the igniting speed of the butane-air mixture at an atmospheric pressure of 32 cm/s. It had been shown that the subject process may be performed with a spark formation at the widest location of the feeding pipe, as illustrated in FIG. 1, as well as with a spark formation in the reduction 7'. For generating a spark a friction wheel-flint arrangement may be used instead of the high voltage discharge illustrated in FIG. 1.

While with low watt applications of the catalytic oxidation one customarily oxidizes butane with air, propane may be used with higher heat capacities. However, the relationships when using propane are very similar to butane, since 286 $mm^3$ propane-air-mixture is required for generating of 1 J heat, instead of 273 $mm^3$ butane-air-mixture; furthermore the ignition speed of propane-air-mixture at atmospheric pressure is also 32 cm/s.

Figure 2:
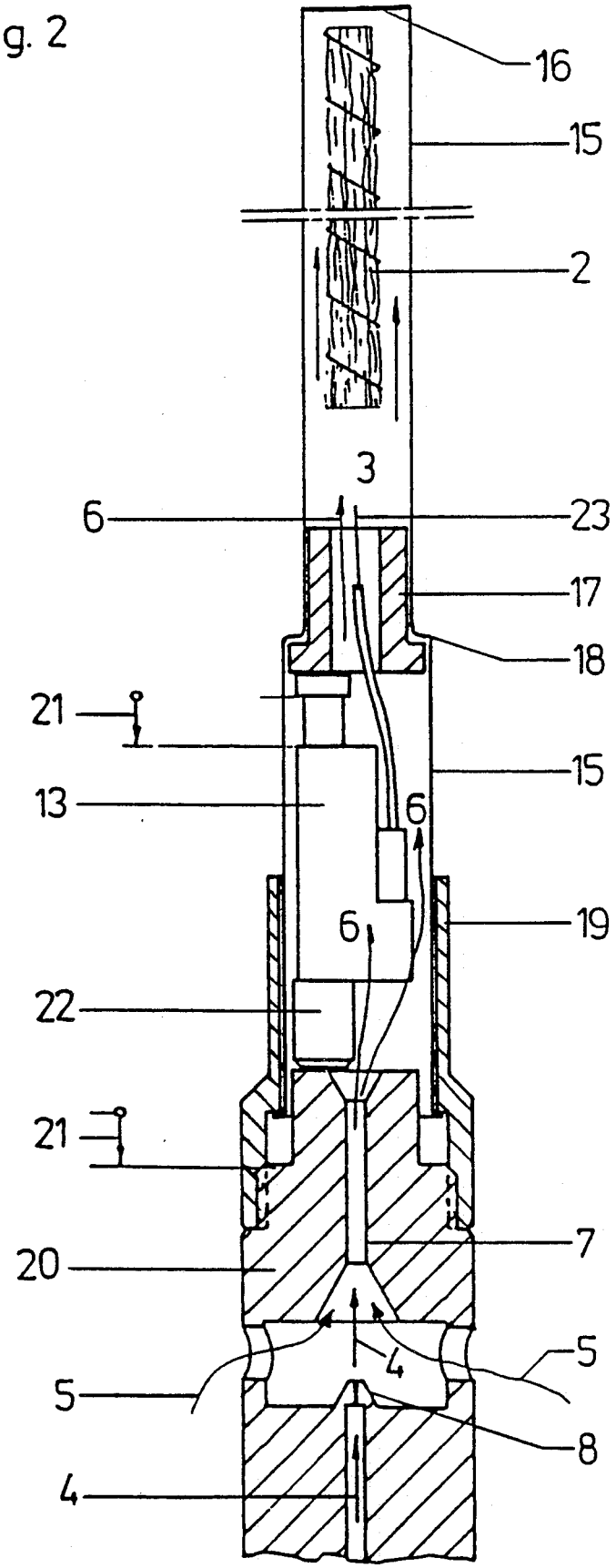

FIG. 2 illustrates a further exemplified embodiment of a device for performing the process. It relates to the essential components of the starter part of a catalytic heating element. From a supply tank, not shown, liquid gas 4 as the fuel flows to a high speed jet 8. Butane or propane or a mixture of the two may be used as liquid gas. The liquid gas 4 and air 5 admix to the fuel mixture 6 in Venturi tube 7. The fuel mixture 6 flows past the piezo-striking mechanism 13 and through the insulation 17 to the catalyst 2. The catalyst 2 and the insulation 17 are sheathed by a tube 15 with shoulder 18. Tube 15 is connected with the base element 20 by a hasp tube 19. This construction enables an axial displacement of tube 15 by the operating stroke 21 of the piezo-striking mechanism 13. The electrode 22 of the piezo-striking mechanism has the same potential than the electrically conductive base element 20 and the metallic tube 15. By an axial displacement of the tube by the stroke 21 the piezo-striking mechanism is actuated whereby a discharge spark is generated between the electrode 23 and the inner side of tube 15. The inner side of tube 15 may be provided with a counter electrode (not shown). The discharge spark ignites the fuel mixture in the area 3 between the insulation 17 and the catalyst 2, whereby the temperature of the part of the catalyst facing the mixture supply is increased to values beyond the starting temperature. The catalytic oxidation which starts subsequently diffuses rapidly in the remainder of the catalyst along tube 15 because of the heat development simultaneously occurring therewith. A stopping of the igniting flame, which in particular would be damaging for the ignition device itself, is prevented by the reduction 16 which does not obstruct the normal flow of the combusted mixture. However, during the sudden combustion of the gas volume in the area of the ignition location 3 a shock wave occurs which is reflected by the reduction 16 to such an extent that the igniting flame is thereby extinguished.

As a particular advantage of the device in accordance with the invention of FIG. 2 it should be mentioned that relatively large catalysts with heat capacities in the kW-range may be actuated by means of a comparatively very low energetic piezo-spark, i.e. without separate energy, for example, from a battery. Should the ignition energy not suffice at first, nothing else is to do but merely enlarge the gas volume which is suddenly reacted during the ignition, that is, to provide a larger distance between the ignition location 3 and the catalyst 2. If this is done heating rods of considerable length may be used which also may be shaped in a known manner in form of heating coils.

Platinum-impregnated quartz mats and platinum-impregnated aluminum oxide mats had been useful as catalysts in the two aforementioned exemplified embodiments, whose starting temperatures were about 150° C.

I claim:

1. In a device for carrying out the flameless catalytic combustion of an ignitable mixture of a combustible gas and air or oxygen flowing through a venturi tube having a reduction, then through an ignition zone having walls defining a volume, and then through a catalyst contiguous with said ignition zone;

a process comprising the steps of:

(a) continuously introducing said combustible gas into said reduction of said venturi tube, in which said air or oxygen admixes therein to form said ignitable mixture;

(b) filling said ignition zone with said ignitable mixture;

(c) igniting in said ignitable mixture in said ignition zone so as to explode said volume of said ignitable mixture and to suddenly heat at least a portion of said catalyst to a temperature sustaining flameless catalytic combustion of said ignitable mixture at said catalyst, said sudden heating of said portion of said catalyst occurring from the direction of flow of said ignitable mixture through said catalyst; and (d) reflecting said exploded ignitable mixture from said catalyst and/or said walls so as to suddenly terminate any combustion from occurring within the flow of said ignitable mixture between said reduction of said venturi tube and said catalyst by momentarily interrupting air or oxygen intake through said reduction of said venturi tube while said combustible gas continues to be introduced into said reduction of said venturi tube.

2. The process of claim 1, wherein step (d) comprises reflecting said exploded ignitable mixture from said catalyst and/or said walls so as to suddenly terminate any flame from occurring within the flow of said ignitable mixture between said reduction of said venturi tube and said catalyst by momentarily interrupting air or oxygen intake through said reduction of said venturi tube while said combustible gas continues to be introduced into said reduction of said venturi tube.

3. The process of claim 1, wherein step (c) comprises generating a spark discharge in the vicinity of said ignition zone to ignite said volume of said ignitable mixture within said ignition zone, and thereby cause said ignitable mixture in said ignition zone to explode and to suddenly heat at least a part of said catalyst to a temperature sustaining flameless combustion of said ignitable mixture of said catalyst, said sudden heating of said part of said catalyst occurring from the direction which said ignitable mixture flows through said catalyst.

4. A device for carrying out the flameless catalytic combustion of an ignitable mixture of combustible gas and air or oxygen, said device comprising:

a catalyst formed having passages so as to allow said ignitable mixture to flow through said passages with a predetermined flow resistance;

an ignition zone having walls and being disposed with respect to said catalyst such that said ignition zone is in communication with said passages of said catalyst, said ignition zone including ignition means for igniting said ignitable mixture within said ignition zone;

admixing means for continuously admixing a supply of combustible gas and air or oxygen to form said ignitable mixture, and for continuously introducing said ignitable mixture into said ignition zone to fill said ignition zone with a volume of said ignitable mixture, said admixing means being in communication with said ignition zone and including a venturi tube having a reduction through which said combustible gas is continuously introduced and oxygen or air is taken in so as to admix with said combustible gas to form said ignitable mixture in said venturi tube;

means for sequentially enabling (a) said admixing means to introduce said ignitable mixture into said ignition zone, to fill said ignition zone with a volume of ignitable mixture while allowing said continually introduced ignitable mixture to flow through said ignition zone and through said passages in said catalyst, and (b) said ignition means to ignite said volume of said ignitable mixture within said ignition zone so as to explode said volume of said ignitable mixture and to suddenly heat at least a portion of said catalyst to a temperature sustaining flameless catalytic combustion of said ignitable mixture at said catalyst, wherein said sudden heating of said portion of said catalyst occurs from the direction of flow of said ignitable mixture toward said catalyst and through said passages, whereby said exploded volume of ignitable mixture is reflected from said catalyst and/or said walls so as to suddenly terminate any combustion from occurring within the flow of said ignitable mixture between said reduction of said venturi tube and said catalyst, by momentarily interrupting air or oxygen intake through said reduction of said venturi tube while said combustible gas continues to be introduced into said reduction of said venturi tube.

5. The device of claim 4, wherein said ignition means comprises a spark producing mechanism.

6. The device of claim 5, wherein said spark producing mechanism comprises one of a piezo spark producing mechanism, a flint spark producing mechanism and a hot electric coil producing mechanism.

7. A device for carrying out the flameless catalytic combustion of an ignitable mixture of combustible gas and air or oxygen, said device comprising:

a catalyst surrounded by a tube having inner walls and an end wall having a small opening therein, said tube and catalyst forming a passage between said catalyst and said inner walls so as to allow for the flow of said ignitable mixture through said passage and through said end opening;

an ignition zone disposed with respect to said catalyst such that said passage is in communication with said ignition zone, said ignition zone including ignition means for igniting said ignitable mixture within said ignition zone;

admixing means for continuously admixing a supply of combustible gas and air or oxygen to form said ignitable mixture, and continuously introducing said ignitable mixture into said ignition zone to fill said ignition zone with a volume of said ignitable mixture; and means for sequentially enabling (a) said admixing means to introduce said ignitable mixture into said ignition zone, to fill said ignition zone with said volume of ignitable mixture while allowing said continually introduced ignitable mixture to flow through said ignition zone, to said catalyst and along said passage and through said small opening in said end wall, and (b) said ignition means to ignite said volume of said ignitable mixture within said ignition zone so as to explode said volume of said ignitable mixture and to suddenly heat at least a portion of said catalyst to a temperature sustaining flameless catalytic combustion of said ignitable mixture at said catalyst, wherein said sudden heating of said portion of said catalyst occurs from the direction of flow of said ignitable mixture toward said catalyst and through said end opening in said tube, whereby a portion of said exploded volume of ignitable mixture is reflected by said end wall of said tube so as to terminate any combustion from occurring along said flow of ignitable mixture between said end wall and said ignition zone.

8. The device of claim 7, wherein said admixing means comprises a venturi tube having a reduction.

9. The device of claim 8, wherein said ignition zone is formed in part by an end of said tube opposite from said end wall.

* * * * *